United States Patent [19]

Powalowski

[11] 4,423,822

[45] Jan. 3, 1984

[54] CLOSURE CAP WITH THUMB ACTUATED REMOVAL ASSISTING TAB

[75] Inventor: Joseph C. Powalowski, Chicago, Ill.

[73] Assignee: Continental White Cap. Inc., Northbrook, Ill.

[21] Appl. No.: 364,278

[22] Filed: Apr. 1, 1982

[51] Int. Cl.[3] ..... B65D 41/46

[52] U.S. Cl. ..... 215/365; 215/253; 215/305

[58] Field of Search ..... 215/253, 254, 305, 365; 220/270

[56] References Cited

U.S. PATENT DOCUMENTS

| | | | |
|---|---|---|---|
| 2,669,369 | 2/1954 | Towns | 215/305 |
| 3,405,830 | 10/1968 | Hayashida | 215/305 X |
| 3,933,264 | 1/1976 | Rossi | 215/254 |

*Primary Examiner*—Donald F. Norton
*Attorney, Agent, or Firm*—Charles E. Brown

[57] ABSTRACT

This relates to closures for containers such as jars and the like wherein the neck finish of the container is provided with an annular locking ring and a skirt of the closure is provided with a series of circumferentially extending and circumferentially spaced lugs for locking the closure in place. The closure may be entirely formed of a resilient plastic or may include only an annular rim which carries a metal panel forming the general end wall of the closure. The skirt is molded so as to define a tab which may be engaged by one's thumb and folded or hinged radially outwardly so as to facilitate application of the necessary lifting force to remove the closure from the container. There are several different tab formations and at least certain of the tabs have associated therewith tamper indicating means.

11 Claims, 24 Drawing Figures

FIG. 1
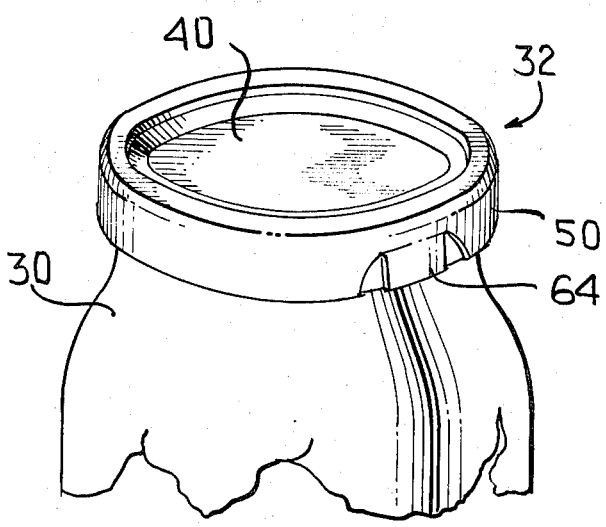
FIG. 3
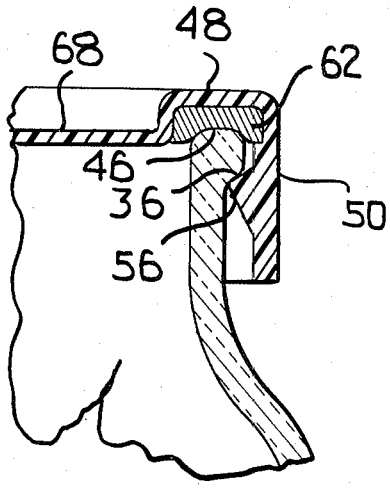
FIG. 2
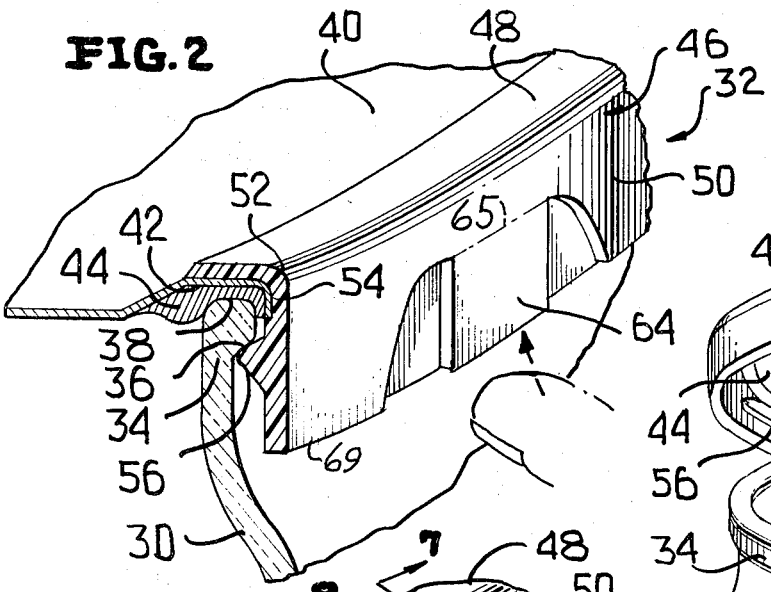
FIG. 4
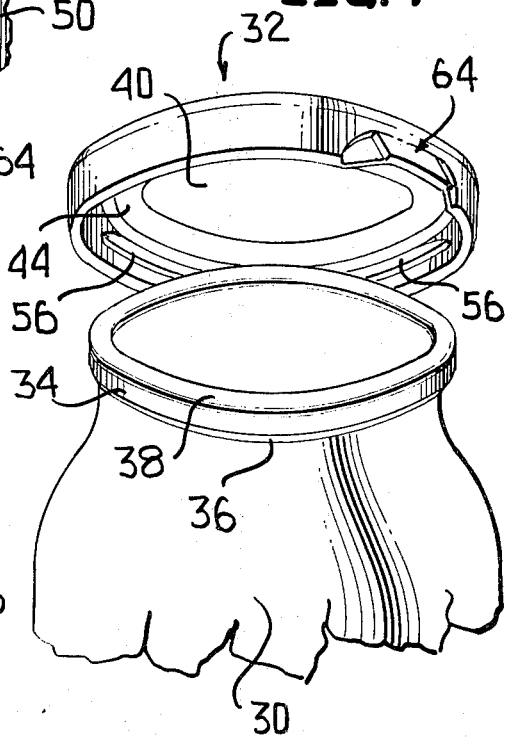
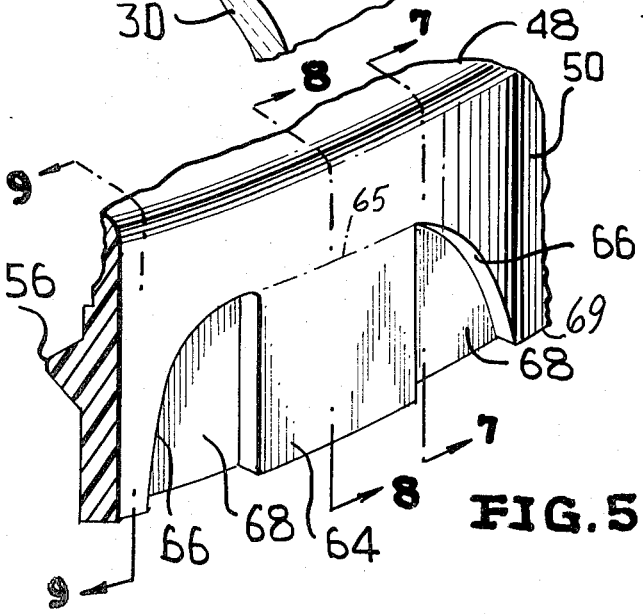
FIG. 5

FIG.6
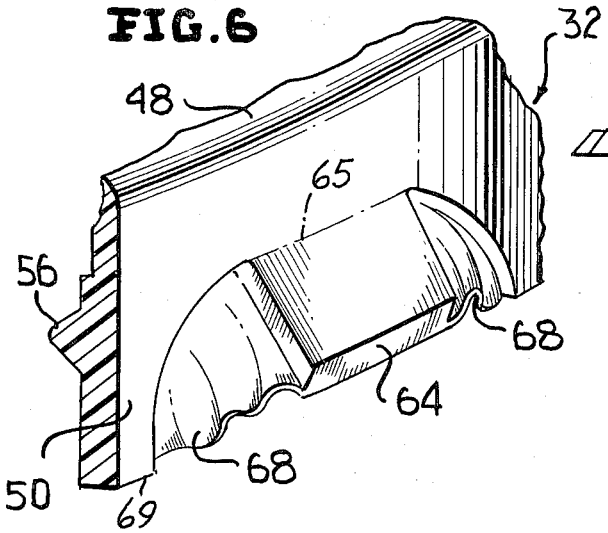
FIG.7
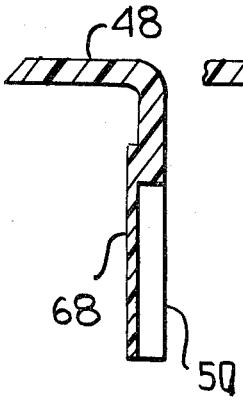
FIG.8
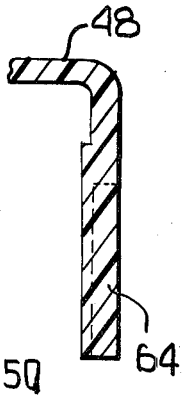
FIG.9
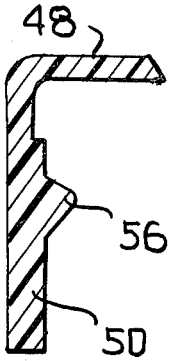
FIG.10
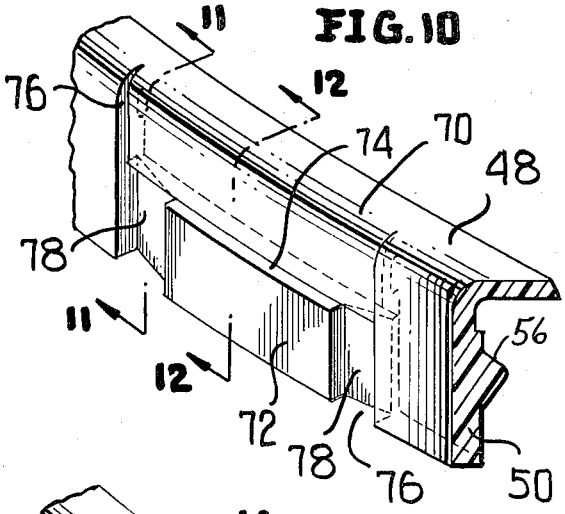
FIG.11
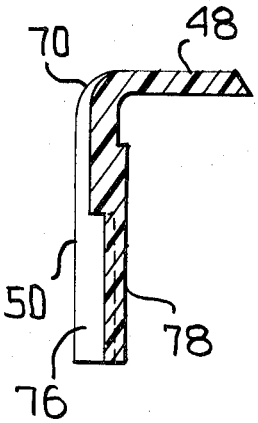
FIG.12
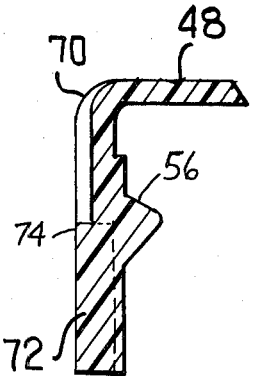
FIG.13
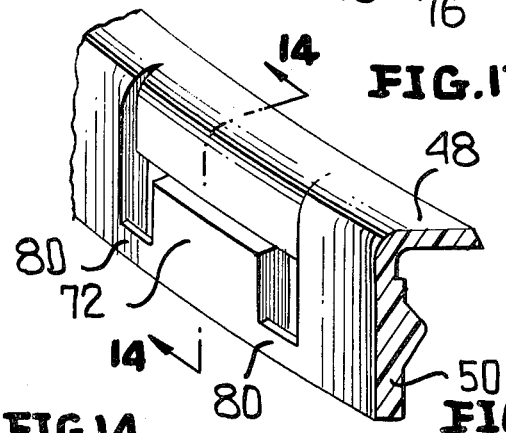
FIG.15
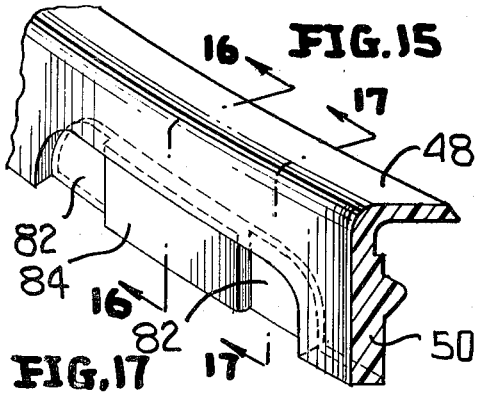
FIG.14
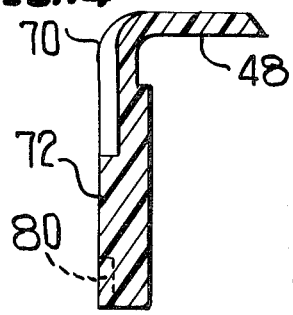
FIG.16
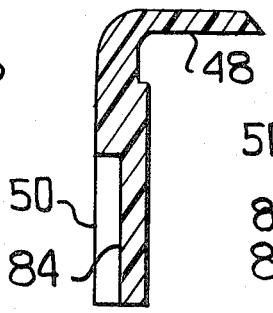
FIG.17
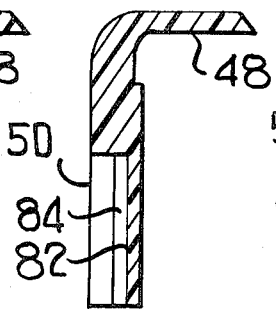
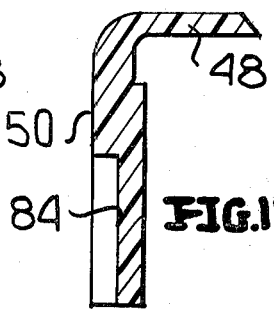
FIG.18

CLOSURE CAP WITH THUMB ACTUATED REMOVAL ASSISTING TAB

This invention relates in general to new and useful improvements in closures for containers, and more particularly to a closure of the snap-on type wherein at least an annular ring portion of the closure including a skirt which interlocks with the neck finish of the container is formed of a resilient plastic.

When snap-on closures are removed from containers, particularly those which have been closed under vacuum, a larger than normal force is required to break the vacuum to remove the closure. This force, in addition to the interlock between the closure skirt and the container neck finish, is dependent upon closure size and vacuum level. Further, when the packaged product has a high degree of fluidity, when the closure is pulled too briskly off, this can result in the undue tipping of the container with resultant spillage.

In accordance with this invention, it is proposed to provide a closure which will have the required interlock with a container neck finish, but wherein the skirt of the closure, without the addition of any depending assisting device, is provided with a tab lying within the general confines of the skirt and formed with the skirt, is provided for engagement with one's thumb to aid in both lifting the closure and deforming the skirt thereof.

Further, in accordance with this invention, the connection between the tab and the remainder of the closure skirt may include tamper-indicating means.

The construction of the tab may vary as may its connection with the remainder of the skirt which permits the radially outward hinging of the tab. In addition, the tamper-indicating means may vary and may include stretchable webs which do not return to their initial configuration once the tab has been utilized, rupturable bridges between the tab and adjacent portions of the remainder of the skirt, and ears carried by the tab and which lock radially behind adjacent portions of the remainder of the skirt.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a fragmentary top perspective view of a closure formed in accordance with this invention and applied to a glass container.

FIG. 2 is a fragmentary perspective view showing the general construction of one closure and the relationship thereof to the neck finish of the container.

FIG. 3 is a sectional view through a modified form of closure, and shows the relationship to an associated glass container neck finish.

FIG. 4 is a fragmentary perspective view of the closure and container of FIG. 1, with the closure substantially removed from the container.

FIG. 5 is an enlarged fragmentary perspective view of a skirt portion of the closure of FIG. 1, showing the details of a removal facilitating tab and associated tamper-indicating means.

FIG. 6 is an enlarged fragmentary perspective view similar to FIG. 5, and shows the tab deflected to an operative position and the tamper-indicating means actuated.

FIG. 7 is a fragmentary transverse sectional view taken generally along the line 7—7 of FIG. 5, and shows the cross section of the skirt in the area of the tamper-indicating means.

FIG. 8 is a similar fragmentary sectional view taken generally along the line 8—8 of FIG. 5, and shows the cross section of the closure skirt through the tab.

FIG. 9 is another fragmentary sectional view taken generally along the line 9—9 of FIG. 5, and shows a typical cross section through the skirt.

FIG. 10 is an enlarged fragmentary perspective view showing a modified form of tab arrangement.

FIG. 11 is a sectional view taken along the line 11—11 of FIG. 10, and shows a section through the closure skirt through the tamper-indicating means thereof.

FIG. 12 is another sectional view taken along the line 12—12 of FIG. 10, and shows the cross section of the closure skirt through the tab.

FIG. 13 is a fragmentary perspective view of a closure skirt portion similar to that of FIG. 10, but with a different type of tamper-indicating means.

FIG. 14 is a sectional view through the closure skirt of FIG. 13 taken along the line 14—14, and shows the details of the tamper-indicating means.

FIG. 15 is a fragmentary perspective view of still another form of the invention.

FIG. 16 is a sectional view through the closure skirt of FIG. 15 taken along the line 16—16, and shows the formation of the thumb assist tab.

FIG. 17 is another sectional view through the closure skirt of FIG. 15, and shows the details of the tamper-indicating means.

FIG. 18 is a sectional view similar to FIG. 17, but shows the closure without a tamper-indicating means.

Figure 19:
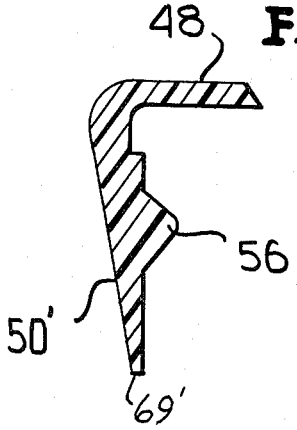
FIG. 19 is an enlarged cross-sectional view of the skirt portion of the closure with the skirt being of a modified cross section.

Referring now to the drawings in detail, it will be seen that there is illustrated in FIG. 1 an an upper portion of a container 30 which is closed by means of a closure formed in accordance with this invention, the closure being generally identified by the numeral 32. For the most part, the closure 32 is of a conventional construction and the subject of the invention to be hereinafter described relates to the provision of a tab which will be engageable by one's thumb to facilitate the application of a removal force to the closure.

Referring now to FIG. 2, it will be seen that the container 30 has a neck finish 34 which includes an outwardly directed closure locking bead 36. The neck finish 34 also includes a terminal sealing surface 38.

The closure 30 illustrated in FIG. 2 is basically of a three-piece construction including a metal panel 40 which is configurated so as to define about its periphery an open channel 42 in which a suitable sealing compound 44 is placed. The closure 32 also includes an annular rim portion 46 which is formed of a relatively stiff but resilient plastic. The annular rim portion 46, in the illustrated embodiment of the invention, includes an annular end panel 48 which has formed integrally therewith and depending therefrom a generally cylindrical skirt 50. At a corner 52 between the annular end panel 48 and the skirt 50 there is provided a recess 54 for receiving the periphery of the metal panel 40 in interlocking relation. It is to be understood that the annular rim 46 will be suitably connected to the metal panel 40 to prevent separation.

It is also to be understood that in accordance with conventional construction the skirt 50 has formed on the radially inner surface thereof a series of circumferentially extending and circumferentially spaced lugs or beads 56 which lock beneath the bead 36 tightly to clamp the sealing compound 42 against the sealing surface 38.

With reference to FIG. 3, it will be seen that there is illustrated a slightly modified form of closure identified by the numeral 58 which is functionally the same as the closure 32, but in lieu of being provided with a separate metal panel such as the metal panel 40 of FIG. 2, the annular panel 48 has integrally connected to the radially inner edge thereof a further panel 60 which is circular in outline. The panel 60, together with the annular panel 48 and the skirt 50, defines a channel 62 into which the sealing compound 46 is placed. The construction of the closure 58 and its relationship to the container 30 is otherwise the same as that set forth above relative to the closure 32, and further description is unnecessary.

It is to be understood that inasmuch as this invention relates to a modification of the skirt portion only of the closure and since the skirt portion will be identical whether the closure is formed entirely of a plastic material or is part plastic and part metal, no distinction will be made in the specific description of the invention as between closure constructions.

Reference is now made to FIG. 5 where there is illustrated one form of the invention where the skirt 50 is so molded in the outer surface thereof as to define a centrally located tab 64 which is defined by a pair of recessed areas 66 in the outer surface of the skirt 50 with the recessed areas 66, in turn, automatically resulting in the formation of thin webs 68. The thin webs 68 extend to a lower free edge 69 of the skirt 50, while the tab 64 has a primary connection along a circumferential line 65 with the remainder of the skirt 50. As is clearly shown in FIG. 5, the connection line 65 is generally in the vicinity of or above the rib or bead 56.

As shown in FIG. 4, when the closure 32 is removed from the container 30, one's thumb is engaged beneath and behind the tab 64 and the same is pulled radially outwardly and axially upwardly to the position shown in FIG. 6, with the tab 64 so deformed it facilitates engagement by one's thumb and the necessary lifting force to move the compound 42 out of sealing engagement with the container sealing surface 38, permitting the container, preferably if it is of the vacuum packed type, to vent. Continued upward movement of the tab 64 together with the adjacent portion of the closure facilitates the removal of the closure in its entirety from the container.

Referring once again to FIG. 6, it will be seen that when the tab 64 is pivoted to its radially outwardly directed position, the webs 68 will have to stretch, and when the tab 64 is returned to its initial position, these webs will give evidence of the fact that the container has been tampered with.

Reference is now made to the embodiment illustrated in FIGS. 10–12. In this embodiment, in lieu of the tab being identified solely by the recesses 66, it will be seen that the upper portion of the skirt 50 is relieved as at 70 above the tab 72 so as to define a general hinge line 74 for the hinging or folding of the tab 72 relative to the skirt 50.

It is also to be noted that the relief in the skirt 50 also extends along opposite sides of the tab 72 as at 76 to define webs 78 connecting opposite side edges of the tab 72 to the remainder of the skirt 50.

It will be understood that the skirt 50 modified in the manner shown in FIG. 10 will function in the same general manner as the modification of FIG. 5, but wherein the required force to bend the tab 72 out of the plane of the skirt 50 should be less than that required for the tab 74.

Referring now to FIG. 13, it will be seen that there is illustrated another form of the invention where, in lieu of the recesses in the skirt 50 at 76, the lower portions of the skirt 50 at opposite sides of the tab 72 will be removed and the tab 72 connected to the remainder of the skirt 50 at opposite sides of the tab 72 by only small bridges 80 as is best shown in FIG. 14.

With the construction of FIGS. 13 and 14, when the tab 72 is lifted and hinged relative to the adjacent upper part of the skirt 50, in lieu of stretching as do the webs 78, the bridges 80 will rupture and give evidence that the closure has been tampered with.

Reference is now made to FIGS. 15–17 wherein there is illustrated another tab arrangement which is very similar to the tab arrangement of FIG. 5, but wherein the skirt 50 has an external surface thereof recessed in such a manner not only to form webs 82 on opposite sides of a tab 84, but also to reduce the radial thickness of the tab 84 so as to facilitate its hinging relative to the remainder of the skirt 50 and the bending thereof beyond the general contour of the skirt.

Reference is now made to the sectional view of FIG. 18 wherein it is shown that, if desired, the webs 82 may be omitted. The closure so constructed would, accordingly, not include a tamper-indicating feature.

In the foregoing embodiments of the invention, the skirt 50 has been illustrated as being generally rectangular in cross section. However, as shown in FIG. 19, the skirt may be of a tapered construction with the skirt having a lesser radial wall thickness at the lower free edge 691 thereof than at its juncture with the annular panel 48. Such skirt is identified by the numeral 50′ and the various tab and tamper-indicating features discussed above may equally as well be incorporated in the skirt 50′.

Figure 20:
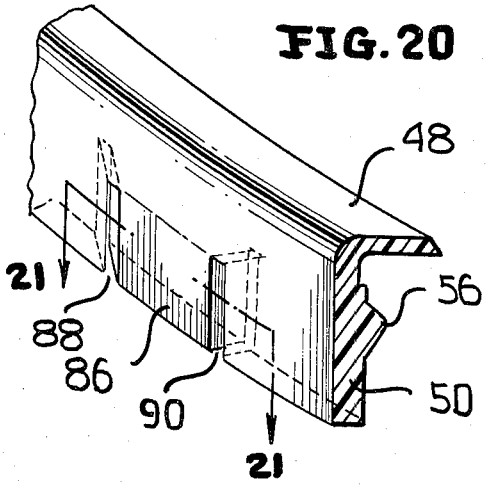
FIG. 20 is a fragmentary perspective view of still another modified form of the invention.
Figure 21:
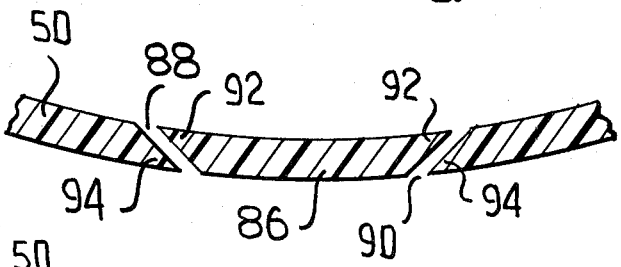
FIG. 21 is a horizontal sectional view taken generally along the line 21—21 of FIG. 20, and shows further the details of the tamper indicating means.

Reference is now made to the embodiment of FIG. 20 wherein a tab 86 is formed from the skirt 50 by means of a pair of oppositely sloping slots 88, 90 formed in the skirt starting at the free edge thereof. As is shown in FIG. 21, the slots 88, 90 define on the tab 86 tapered ears 92 and on the adjacent portions of the remainder of the skirt 50 tapered shoulders 94.

Figure 22:
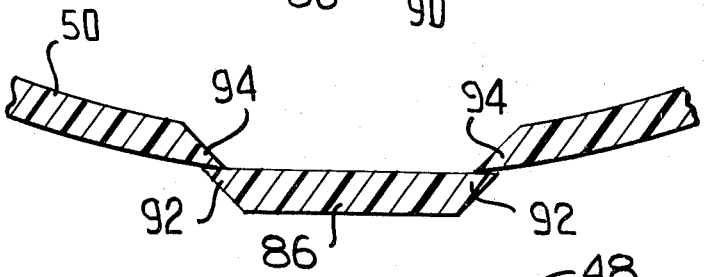
FIG. 22 is a sectional view similar to FIG. 21, and shows the tab of FIG. 20 in a displaced position with the tamper-indicating means being operative.

In the initial position of the tab 86, the ears 92 are disposed behind the shoulders 94 and the tab 86 is in the general plane of the remainder of the skirt 50. However, when the tab 86 is pulled from the general plane of the skirt 50 as disclosed hereinabove to permit the application of a lifting force to the closure, the ears 92 will cam against the shoulders 94 with a resultant bending of both the ears and the shoulders and the movement of the ears 92 radially outwardly to positions radially outwardly of the shoulders 94. Then, when the tab 86 is released, as shown in FIG. 22, the ears 92 will abut against the shoulders 94 and the tab 86 will not return to its original position, thereby giving visual evidence to the fact that the tab has been pulled outwardly in the manner generally required in the opening of the container.

Figure 23:
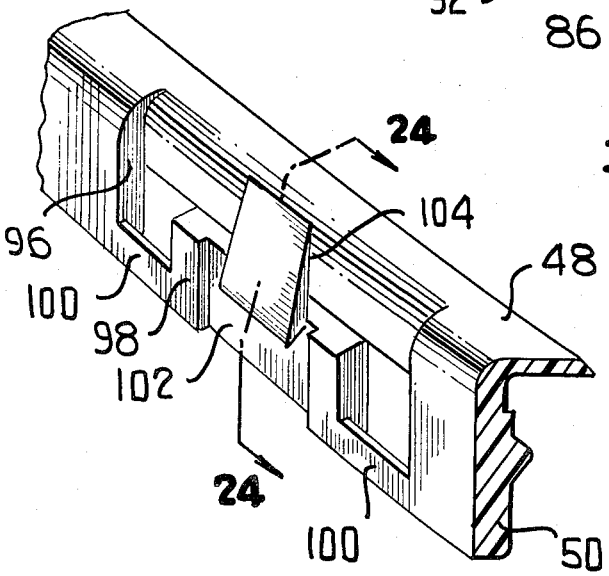
FIG. 23 is an enlarged fragmentary perspective view of still a further embodiment of the invention.
Figure 24:
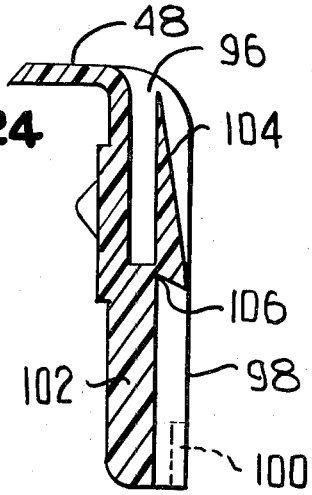
FIG. 24 is a sectional view taken generally along the line 24—24 of FIG. 23, and shows the details of an additional tamper-indicating device.

In FIG. 23 there is illustrated yet another form of opening tab arrangement. In this tab arrangement an upper and outer part of the skirt 50 is recessed as at 96 to define a tab 98 of full skirt thickness which is joined to adjacent portions of the remainder of the skirt 50 by bridges 100 in the manner generally shown in FIG. 13. However, the outer surface of the tab 98 is provided with a central recess 102 and integrally connected to the upper edge of the tab 102 is a tamper-indicating member 104 which is hingedly connected to the tab 98 as at 106. It will be readily apparent from FIG. 24 that when the tab 98 is radially outwardly displaced in a customary closure removal operation, the bridges 100 will rupture to give evidence of tampering. As the tab 98 is moved further radially outwardly, it will force the tamper-indicating member 104 against the upper part of the skirt with the result that the tamper-indicating member 104 will either be materially displaced from its original position to give evidence of tampering, or it may be entirely torn from the tab 98 due to the frangibility of the connection 106.

It is to be noted that all of the closure removal facilitating tabs have the advantage of being formed entirely from the material of the original skirt, thereby not only failing to require additional material in the formation thereof, but also actually resulting in a saving of material. Further, it will be seen that no part of any of the tabs or tamper-indicating means associated therewith projects beyond the contour of the skirt so as in no way to interfere with the normal application of the closure or the packing of containers employing such closures.

Although only preferred embodiments of the closure construction have been specifically illustrated and described herein, it is to be understood that minor modifications may be made in the closure construction without departing from the spirit and scope of the invention as defined by the appended claims.

I claim:

1. A snap-on closure for containers, said closure having at least an annular rim portion including a depending skirt formed of a deformable plastic, said skirt having an internal bead for locking relative to a container neck finish; said closure being improved by said skirt having formed in the confines of said skirt a skirt portion disposed along a free edge of said skirt and deflectable from the contour of said skirt and defining a thumb engageable tab for facilitating the application of a lifting removal force to said closure, said tab being integral with said skirt and having a primary connection with the remainder of said skirt along a circumferential line spaced from said skirt free edge a distance at least as great as the spacing of a central part of said bead from said free edge of said skirt.

2. A snap-on closure according to claim 1 wherein said circumferential line is spaced from said skirt free edge to be axially above said bead.

3. A snap-on closure for containers, said closure having at least an annular rim portion including a depending skirt formed of a deformable plastic, said skirt having an internal bead for locking relative to a container neck finish; said closure being improved by said skirt having formed in the confines of said skirt a skirt portion disposed along a free edge of said skirt and deflectable from the contour of said skirt and defining a thumb engageable tab for facilitating the application of a lifting removal force to said closure, said tab having axial edges completely separated from said circumferentially adjacent portions of the remainder of said skirt.

4. A snap-on closure according to claim 3 wherein said axial edges are spaced from adjacent portions of the remainder of said skirt.

5. A snap-on closure according to claim 3 wherein there are tamper-indicating means between said tab and the remainder of said skirt along said axial edges.

6. A snap-on closure according to claim 3 wherein there are tamper-indicating means between said tab and the remainder of said skirt along said axial edges, said tamper-indicating means being in the form of ears along said axial edges and initially locked radially inwardly of the adjacent portions of the remainder of said skirt and movable with said tab to non-returnable positions radially outwardly of said adjacent skirt portions.

7. A snap-on closure for containers, said closure having at least an annular rim portion including a depending skirt formed of a deformable plastic, said skirt having an internal bead for locking relative to a container neck finish; said closure being improved by said skirt having formed in the confines of said skirt a skirt portion disposed along a free edge of said skirt and deflectable from the contour of said skirt and defining a thumb engageable tab for facilitating the application of a lifting removal force to said closure, tamper-indicating means between said tab and adjacent portions of the remainder of said skirt, said tamper-indicating means being in the form of stretchable non-returnable webs.

8. A snap-on closure for containers, said closure having at least an annular rim portion including a depending skirt formed of a deformable plastic, said skirt having an internal bead for locking relative to a container neck finish; said closure being improved by said skirt having formed in the confines of said skirt a skirt portion disposed along a free edge of said skirt and deflectable from the contour of said skirt and defining a thumb engageable tab for facilitating the application of a lifting removal force to said closure, said tab being of a radial thickness less than the remainder of said skirt and being recessed radially inwardly of the contour of said skirt.

9. A snap-on closure according to claim 8 together with tamper-indicating means between said tab and adjacent portions of the remainder of said skirt.

10. A snap-on closure for containers, said closure having at least an annular rim portion including a depending skirt formed of a deformable plastic, said skirt having an internal bead for locking relative to a container neck finish; said closure being improved by said skirt having formed in the confines of said skirt a skirt portion disposed along a free edge of said skirt and deflectable from the contour of said skirt and defining a thumb engageable tab for facilitating the application of a lifting removal force to said closure, said tab being of the same general radial thickness as a major portion of the remainder of said skirt, the remainder of said skirt being of a radially inwardly reduced radial thickness axially above said tab, said tab having a radially inwardly recessed central portion, and said tab having connected to an upper part thereof and partially seated in said recessed central portion a bendable tamper-indicating member.

11. A snap-on closure according to claim 10 wherein said tamper-indicating means are in the form of rupturable bridges.

* * * * *